US010005290B1

(12) United States Patent
Wurmfeld

(10) Patent No.: US 10,005,290 B1
(45) Date of Patent: Jun. 26, 2018

(54) LASER ASSEMBLY FOR A LASER PRINTER

(71) Applicant: Capital One Services, LLC, McLean, VA (US)

(72) Inventor: David Kelly Wurmfeld, Fairfax, VA (US)

(73) Assignee: Capital One Services, LLC, McLean, VA (US)

( * ) Notice: Subject to any disclaimer, the term of this patent is extended or adjusted under 35 U.S.C. 154(b) by 0 days. days.

(21) Appl. No.: 15/816,707

(22) Filed: Nov. 17, 2017

(51) Int. Cl.
*B41J 2/455* (2006.01)
*B41J 2/47* (2006.01)

(52) U.S. Cl.
CPC ..... *B41J 2/455* (2013.01); *B41J 2/473* (2013.01)

(58) Field of Classification Search
CPC ... B41J 2/442; B41J 2/471; B41J 2/473; B41J 2/5056; B41J 29/38; B41J 2/45; B41J 2/475; B41J 2/455
USPC ..... 347/224, 233, 252
See application file for complete search history.

(56) References Cited

U.S. PATENT DOCUMENTS

| | | | | |
|---|---|---|---|---|
| 4,578,689 | A | 3/1986 | Spencer et al. | |
| 4,613,877 | A | 9/1986 | Spencer et al. | |
| 5,239,313 | A | 8/1993 | Marko et al. | |
| 5,521,999 | A | 5/1996 | Chuang et al. | |
| 5,625,402 | A | 4/1997 | Sarraf | |
| 5,929,892 | A | 7/1999 | Towner et al. | |
| 6,064,417 | A | 5/2000 | Harrigan et al. | |
| 6,888,853 | B1 * | 5/2005 | Jurgensen | B23K 26/0604 347/224 |
| 2014/0307242 | A1 * | 10/2014 | Solak | G03F 7/70408 355/67 |

* cited by examiner

*Primary Examiner* — Jannelle M Lebron
(74) *Attorney, Agent, or Firm* — Harrity & Harrity, LLP

(57) ABSTRACT

An example laser assembly for a laser printer may include a plurality of lasers to emit respective photons; a prism to redirect the respective laser beams emitted from the plurality of lasers toward a collimator lens of the laser printer to generate a photon beam; and one or more processors to: determine a timing schedule for individually activating the plurality of lasers based on a resolution setting of the laser printer, and when printing at a resolution corresponding to the resolution setting, control activation of each of the plurality of lasers to emit the respective photons according to the timing schedule to form the photon beam.

20 Claims, 8 Drawing Sheets

LASER ASSEMBLY FOR A LASER PRINTER

BACKGROUND

A laser printer uses a laser (a device that emits a laser beam) to print an image on paper. The laser printer may use various components (e.g., a scanning mirror, a corona wire, a photo drum, a fuser unit, and/or the like) to apply a charge to the paper such that ink (e.g., toner) from an ink cartridge (or toner roller) is transferred to the paper through static electric charges. Accordingly, the laser printer may be used to convert a digital image into a physical image on a printing substrate (e.g., paper, cardboard, plastic, wood, metal, and/or the like).

SUMMARY

According to some implementations, a device may include one or more processors to identify a resolution setting of a laser printer, the resolution setting indicating a resolution at which the laser printer is to print; determine a set of lasers, from a plurality of lasers of a laser assembly, that are to be used to print at the resolution, the laser assembly comprising the plurality of lasers to emit respective photons toward a prism, where the prism is to redirect the respective photons toward a collimator lens of the laser printer to form a photon beam; determine a timing schedule for activating each laser of the set of lasers that are to be used to print at the resolution, using the photon beam, based on the resolution setting; and when printing at the resolution, activate the set of lasers to emit the respective photons according to the timing schedule.

According to some implementations, a laser printer may include a laser assembly including a collimator lens; a plurality of lasers to emit respective photons; a prism to redirect the respective photons from the plurality of lasers toward the collimator lens; a photo drum, where the respective photons, redirected through the collimator lens, are combinable for generating a photon beam to create a charge zone on the photo drum to achieve a printing resolution of at least 3600 dots per inch (DPI); and one or more processors to: determine a timing schedule for activating each of the plurality of lasers to emit the respective photons to generate the photon beam, where the timing schedule is based on a resolution setting of the laser printer indicating the printing resolution; and activate the plurality of lasers to emit the respective photons when printing at the printing resolution according to the timing schedule.

According to some implementations, a laser assembly for a laser printer may include a plurality of lasers to emit respective photons; a prism to redirect the respective laser beams emitted from the plurality of lasers toward a collimator lens of the laser printer to generate a photon beam; and one or more processors to: determine a timing schedule for individually activating the plurality of lasers based on a resolution setting of the laser printer, and when printing at a resolution corresponding to the resolution setting, control activation of each of the plurality of lasers to emit the respective photons according to the timing schedule to form the photon beam.

DETAILED DESCRIPTION

The following detailed description of example implementations refers to the accompanying drawings. The same reference numbers in different drawings may identify the same or similar elements.

Figure 1A:
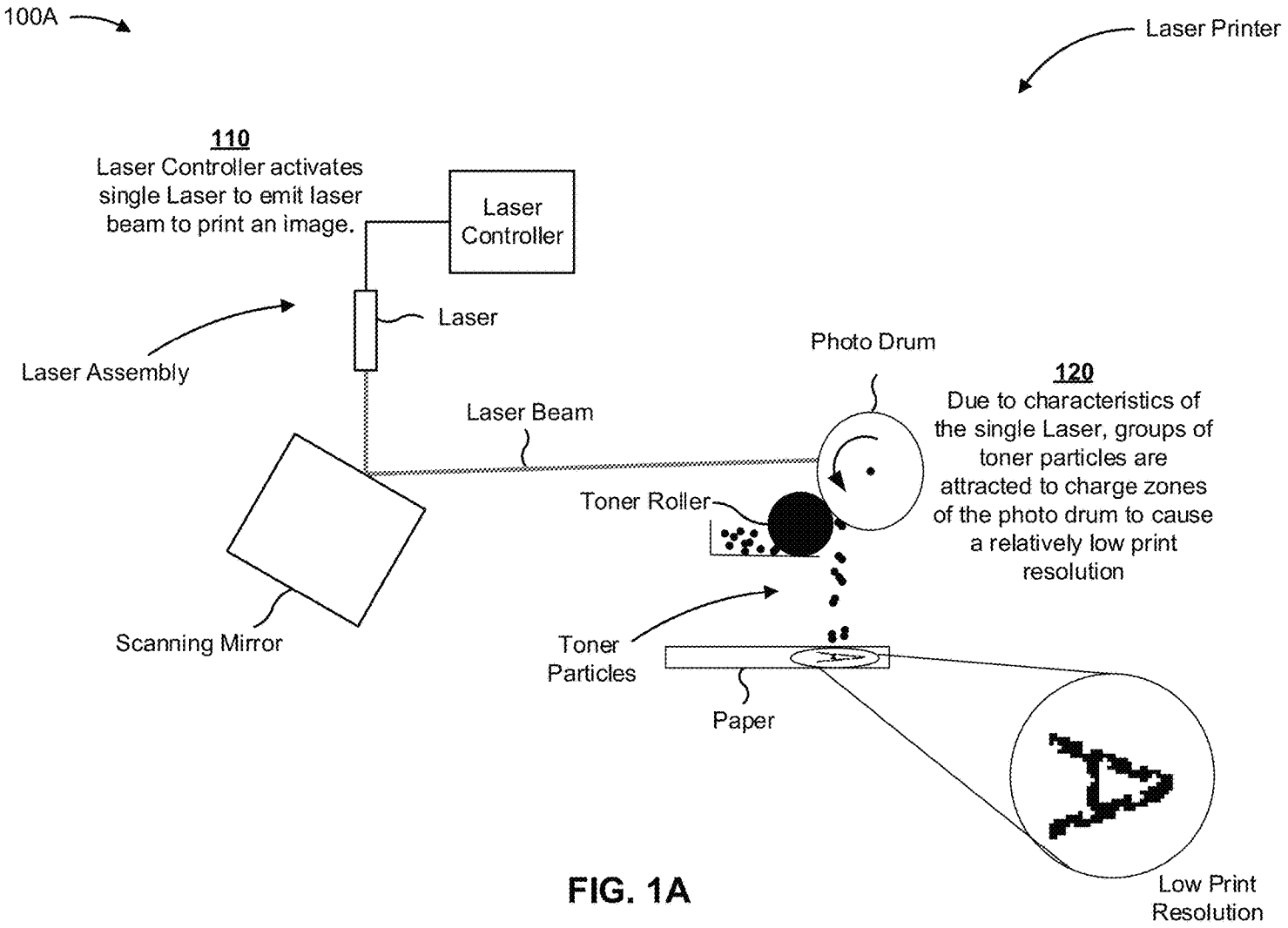
FIGS. 1A and 1B are diagrams of an overview of example implementations described herein.
Figure 1B:
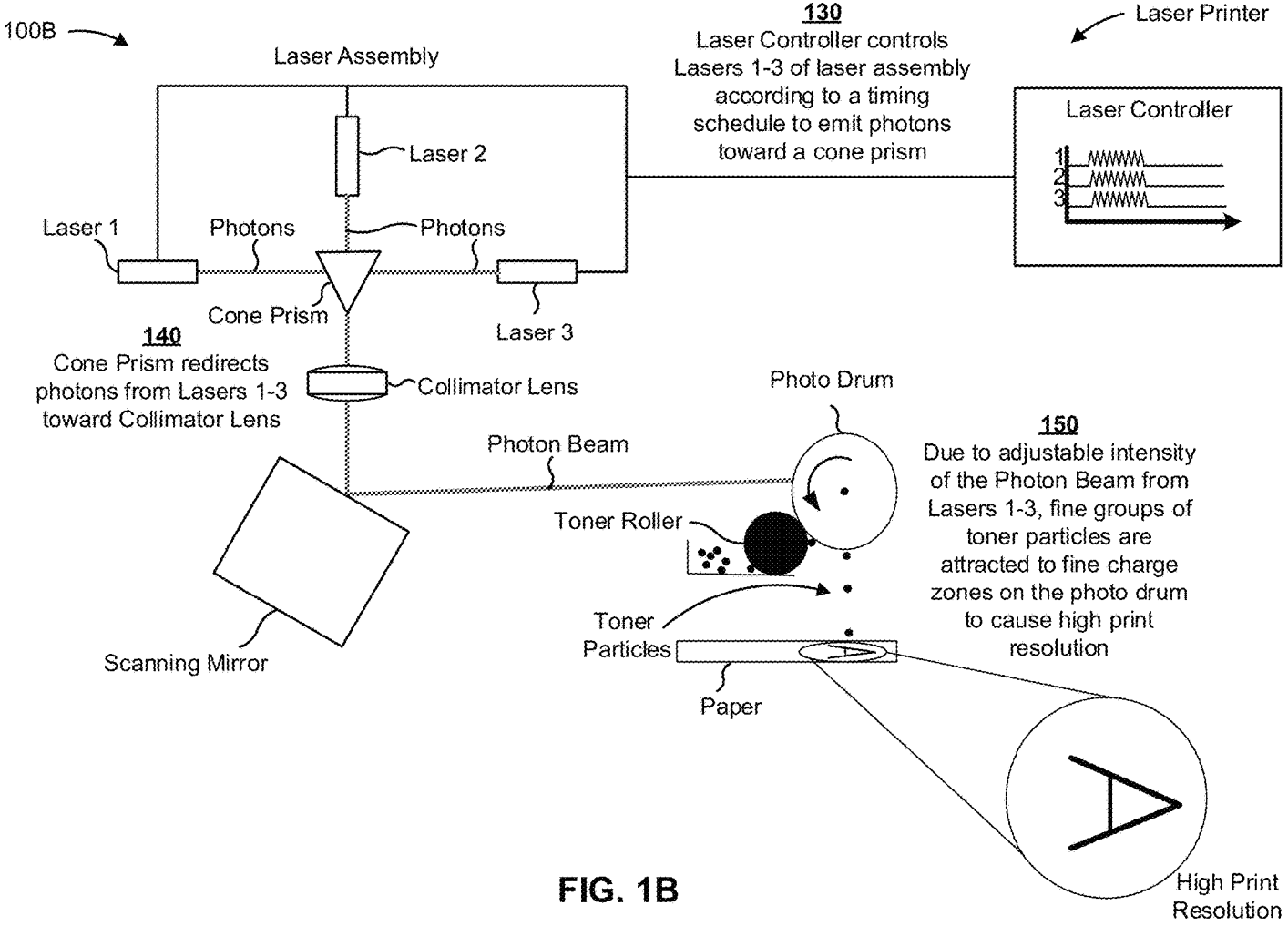

FIGS. 1A and 1B are diagrams of an overview of example implementations 100A and 100B, respectively, described herein. In example implementation 100A of FIG. 1A, a laser printer prints at a relatively low resolution due to the characteristics of the laser, while in example implementation 100B of FIG. 1B, the laser printer prints at a relatively high resolution, as described herein.

As shown in FIG. 1A, and by reference number 110, a laser controller activates a single laser (e.g., a laser diode) of a laser assembly to emit a laser beam (or a laser pulse) to print an image. For example, the laser controller of example implementation 100A may receive print data associated with the image and use the print data to control the laser (e.g., apply power to turn the laser on and off) and/or control a scanning mirror to correspondingly alter, via the laser beam, the charge of charge zones of a photo drum to form the image on a charged piece of paper. For example, the photo drum may be positively charged (e.g., via a corona wire of the laser printer) and the laser beam may create negatively charged charge zones on the photo drum that correspond to the image. In such a case, the paper may be positively charged to attract negatively charged toner particles from the charge zones on the photo drum to form the image on the piece of paper. To increase resolution of printing, the laser controller may attempt to power on and power off the laser to create a laser pulse to lessen an intensity of the laser beam and corresponding dimensions (e.g., length, width, charge intensity, and/or the like) of the charge zones on the photo drum. In other words, dimensions of the charge zones on the photo drum (and resulting dimensions of pixels of an image on the paper) may correspond to the intensity of the laser beam.

However, as shown in FIG. 1A, and by reference number 120, due to the characteristics of the single laser in example implementation 100A, groups of toner particles are attracted to the charge zones of the photo drum (caused by the laser beam) to cause a relatively low print resolution (e.g., 3600 dots per inch (DPI) or less). For example, the laser beam may create a charge zone of the photo drum that causes relatively low print resolution. More specifically, a group of toner particles, comprised of approximately 45 or more toner particles, may be attracted to the photo drum for a single pixel of the image based on the dimensions of the charge zone created by the laser beam. In some cases, such characteristics of the laser may include a photon cycle time that may not be fast enough to enable the laser to power on to emit photons, power off before reaching a full laser beam threshold (e.g., to emit the laser beam), and power back on to emit photons while emitting enough photons (emitting an intense enough photon beam) to create a charge zone on the photo drum. In other words, the laser controller cannot turn on and turn off the laser fast enough to achieve a high resolution (e.g., greater than 3600 DPI). As such, these groups of toner particles are transferred to the paper at the relatively low print resolution.

As shown in FIG. 1B, and by reference number 130, a laser controller controls a plurality of lasers (Lasers 1-3) of a laser assembly according to a timing schedule. The laser assembly, as shown in FIG. 1B, also includes a cone prism and a collimator lens. The scanning mirror, photo drum, toner, and/or paper may be charged and/or utilized in a similar manner as example implementation 100A of FIG. 1A. In some implementations, the laser printer in example implementation 100B may be a same laser printer that is in example implementation 100A other than the laser assemblies of FIGS. 1A and 1B.

In example implementation 100B of FIG. 1B, as shown by the timing schedule, the laser controller may stagger times at which each of Lasers 1-3 are powered on and/or powered off to achieve an adjustable intensity of a photon beam (which may have a lower intensity than a laser beam emitted by Lasers 1-3, as well as a laser beam emitted by the laser in FIG. 1A). As shown by reference number 140 of example implementation 100B, a cone prism redirects photons from Lasers 1-3 toward a collimator lens. The collimator lens of example implementation 100B may be shaped to focus the adjustable photon beam from the cone prism before the adjustable photon beam reaches the scanning mirror. In some implementations, Lasers 1-3 may emit respective photons incident to the cone prism (into a conical surface (or radial surface) of the cone prism), which redirects the photons ninety degrees through the tip of the cone toward the collimator lens. As such, a photon beam (e.g., which may be an adjustable intensity laser beam) may be formed from the cone prism due to the laser controller correspondingly powering on and powering off Lasers 1-3 to achieve the photon beam. The photon beam of example implementation 100B may have a lower intensity than the laser beam of example implementation 100A (and/or a lower intensity than a laser beam emitted from Lasers 1-3 of example implementation 100B).

As further shown in FIG. 1B, and by reference number 150, due to the adjustable intensity of the photon beam from Lasers 1-3, fine groups of toner particles are attracted to fine charge zones on the photo drum (caused by the adjustable laser beam) to cause a high print resolution (e.g., greater than 3600 DPI). For example, a fine group of toner particles comprised of approximately 1-20 toner particles may be formed on the photo drum to correspond to a single pixel of the image based on the dimensions of the charge zone created by the photon beam. Accordingly, the photon beam may be controlled to have an intensity that creates fine charge zones on the photo drum that have relatively small dimensions (e.g., relative to the charge zones of example implementation 100A). As such, fine groups of toner particles may be attracted to the fine charge zones and transferred to the paper at a high print resolution (e.g., greater than 3600 DPI). Furthermore, according to example implementation of 100B, the laser printer may conserve toner because less toner may be used (e.g., 10-20 particles per pixel versus 45 or more particles per pixel in example implementation 100A) to form an image using the higher resolution.

As indicated above, FIGS. 1A and 1B are provided merely as an example. Other examples are possible and may differ from what was described with regard to FIGS. 1A and 1B. Furthermore, additional components may be included in example implementations 100A and 100B of FIGS. 1A and 1B, respectively.

Figure 2:
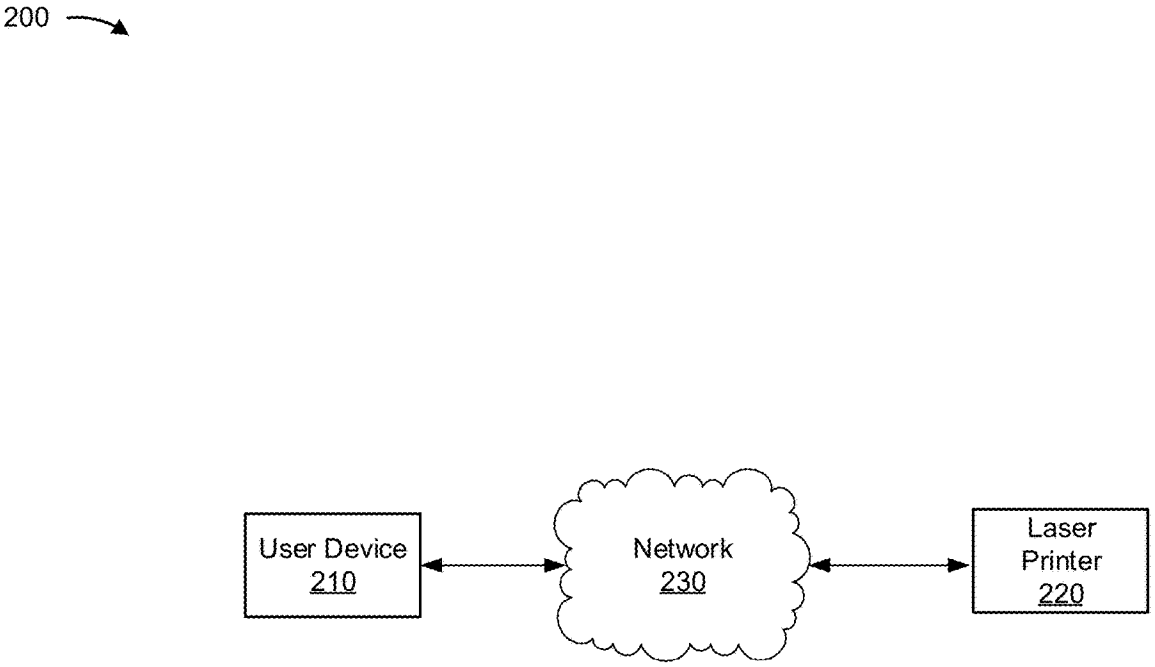
FIG. 2 is a diagram of an example environment in which systems and/or methods, described herein, may be implemented.

FIG. 2 is a diagram of an example environment 200 in which systems and/or methods, described herein, may be implemented. As shown in FIG. 2, environment 200 may include user device 210, laser printer 220, and network 230. Devices of environment 200 may interconnect via wired connections, wireless connections, or a combination of wired and wireless connections.

User device 210 includes one or more devices capable of receiving, generating, storing, processing, and/or providing information associated with printing an image via laser printer 220. For example, user device 210 may include a communication and a computing device, such as a mobile phone (e.g., a smart phone, a radiotelephone, etc.), a laptop computer, desktop computer, a server device, a tablet computer, a handheld computer, a gaming device, a wearable communication device (e.g., a smart wristwatch, a pair of smart eyeglasses, etc.), or a similar type of device. As such, user device 210 may send a printing a request including printing information to cause laser printer 220 to print an image. The printing request may include a file (e.g., a document, a digital image, a message, and/or the like) that includes an image that is to be printed, preferences (e.g., resolution, size, color, and/or the like) for the printing of the image, security information associated with printing the printed image, and/or the like.

Laser printer 220 may include any device capable of printing images on a printing substrate (e.g., paper, cardboard, plastic, wood, metal, and/or the like) using a laser (e.g., a laser diode). Laser printer 220 may include a laser assembly that includes a plurality of lasers and/or one or more processors to control the plurality of lasers. The laser assembly of laser printer 220 may include a cone prism, a collimator lens, and/or a laser controller to achieve a high print resolution. According to some implementations described herein, laser printer 220 may achieve the high print resolution (e.g., greater than 3600 DPI) utilizing a timing schedule to activate and/or deactivate the plurality of lasers. Laser printer 220 may include a communication device and/or a user interface to receive printing requests and/or instructions for printing an image.

Network 230 includes one or more wired and/or wireless networks. For example, network 230 may include a cellular network (e.g., a long-term evolution (LTE) network, a code division multiple access (CDMA) network, a 3G network, a 4G network, a 5G network, another type of next generation network, etc.), a public land mobile network (PLMN), a local area network (LAN), a wide area network (WAN), a metropolitan area network (MAN), a telephone network (e.g., the Public Switched Telephone Network (PSTN)), a private network, an ad hoc network, an intranet, the Internet, a fiber optic-based network, a cloud computing network, or the like, and/or a combination of these or other types of networks.

The number and arrangement of devices and networks shown in FIG. 2 are provided as an example. In practice, there may be additional devices and/or networks, fewer devices and/or networks, different devices and/or networks, or differently arranged devices and/or networks than those shown in FIG. 2. Furthermore, two or more devices shown in FIG. 2 may be implemented within a single device, or a single device shown in FIG. 2 may be implemented as multiple, distributed devices. Additionally, or alternatively, a set of devices (e.g., one or more devices) of environment 200 may perform one or more functions described as being performed by another set of devices of environment 200.

Figure 3:
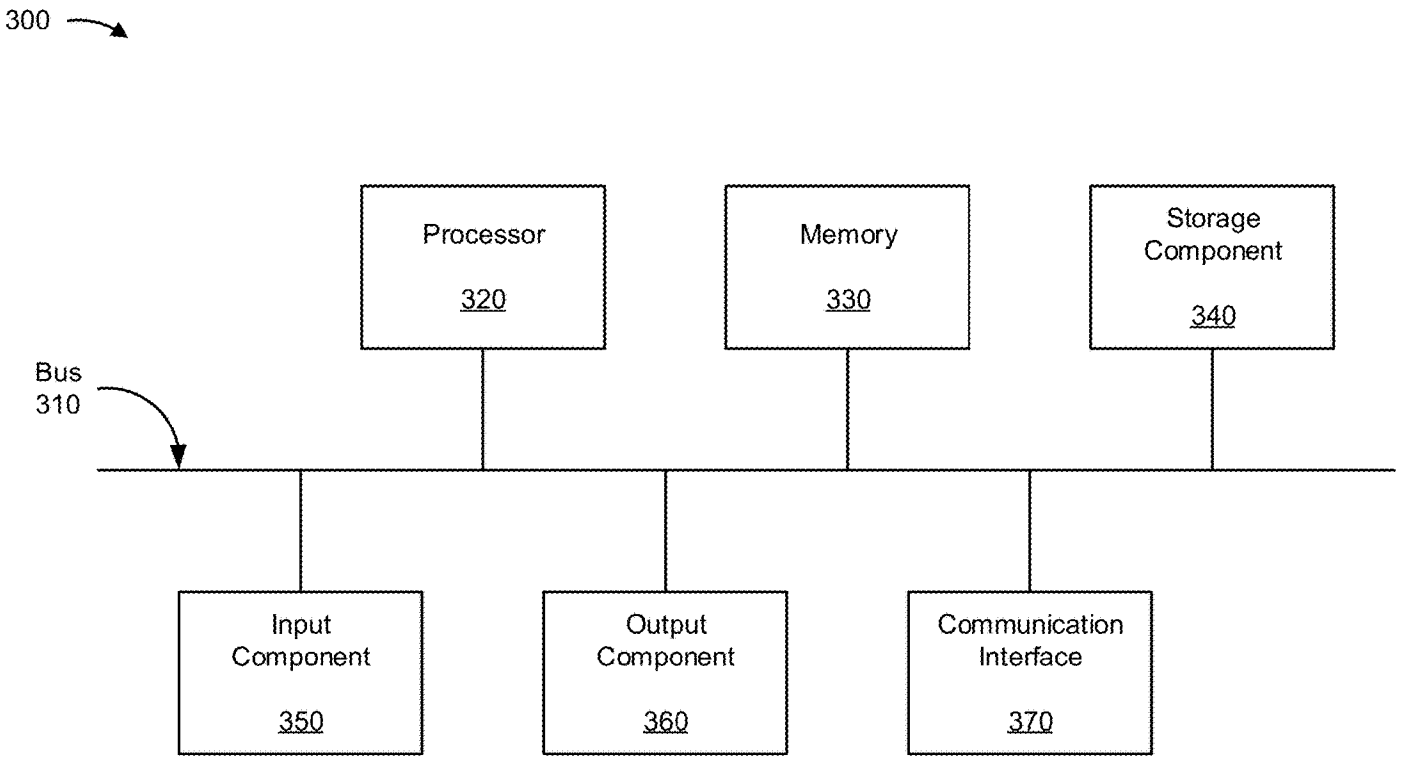
FIG. 3 is a diagram of example components of one or more devices of FIG. 2.

FIG. 3 is a diagram of example components of a device 300. Device 300 may correspond to user device 210 and/or laser printer 220. In some implementations, user device 210 and/or laser printer 220 may include one or more devices 300 and/or one or more components of device 300. As shown in FIG. 3, device 300 may include a bus 310, a processor 320, a memory 330, a storage component 340, an input component 350, an output component 360, and a communication interface 370.

Bus 310 includes a component that permits communication among the components of device 300. Processor 320 is implemented in hardware, firmware, or a combination of hardware and software. Processor 320 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. In some implementations, processor 320 includes one or more processors capable of being programmed to perform a function. Memory 330 includes a random access memory (RAM), a read only memory (ROM), and/or another type of dynamic or static storage device (e.g., a flash memory, a magnetic memory, and/or an optical memory) that stores information and/or instructions for use by processor 320.

Storage component 340 stores information and/or software related to the operation and use of device 300. For example, storage component 340 may include a hard disk (e.g., a magnetic disk, an optical disk, a magneto-optic disk, and/or a solid state disk), a compact disc (CD), a digital versatile disc (DVD), a floppy disk, a cartridge, a magnetic tape, and/or another type of non-transitory computer-readable medium, along with a corresponding drive.

Input component 350 includes a component that permits device 300 to receive information, such as via user input (e.g., a touch screen display, a keyboard, a keypad, a mouse, a button, a switch, and/or a microphone). Additionally, or alternatively, input component 350 may include a sensor for sensing information (e.g., a global positioning system (GPS) component, an accelerometer, a gyroscope, and/or an actuator). Output component 360 includes a component that provides output information from device 300 (e.g., a display, a speaker, and/or one or more light-emitting diodes (LEDs)).

Communication interface 370 includes a transceiver-like component (e.g., a transceiver and/or a separate receiver and transmitter) that enables device 300 to communicate with other devices, such as via a wired connection, a wireless connection, or a combination of wired and wireless connections. Communication interface 370 may permit device 300 to receive information from another device and/or provide information to another device. For example, communication interface 370 may include an Ethernet interface, an optical interface, a coaxial interface, an infrared interface, a radio frequency (RF) interface, a universal serial bus (USB) interface, a Wi-Fi interface, a cellular network interface, or the like.

Device 300 may perform one or more processes described herein. Device 300 may perform these processes based on processor 320 executing software instructions stored by a non-transitory computer-readable medium, such as memory 330 and/or storage component 340. A computer-readable medium is defined herein as a non-transitory memory device. A memory device includes memory space within a single physical storage device or memory space spread across multiple physical storage devices.

Software instructions may be read into memory 330 and/or storage component 340 from another computer-readable medium or from another device via communication interface 370. When executed, software instructions stored in memory 330 and/or storage component 340 may cause processor 320 to perform one or more processes described herein. Additionally, or alternatively, hardwired circuitry may be used in place of or in combination with software instructions to perform one or more processes described herein. Thus, implementations described herein are not limited to any specific combination of hardware circuitry and software.

The number and arrangement of components shown in FIG. 3 are provided as an example. In practice, device 300 may include additional components, fewer components, different components, or differently arranged components than those shown in FIG. 3. Additionally, or alternatively, a set of components (e.g., one or more components) of device 300 may perform one or more functions described as being performed by another set of components of device 300.

Figure 4:
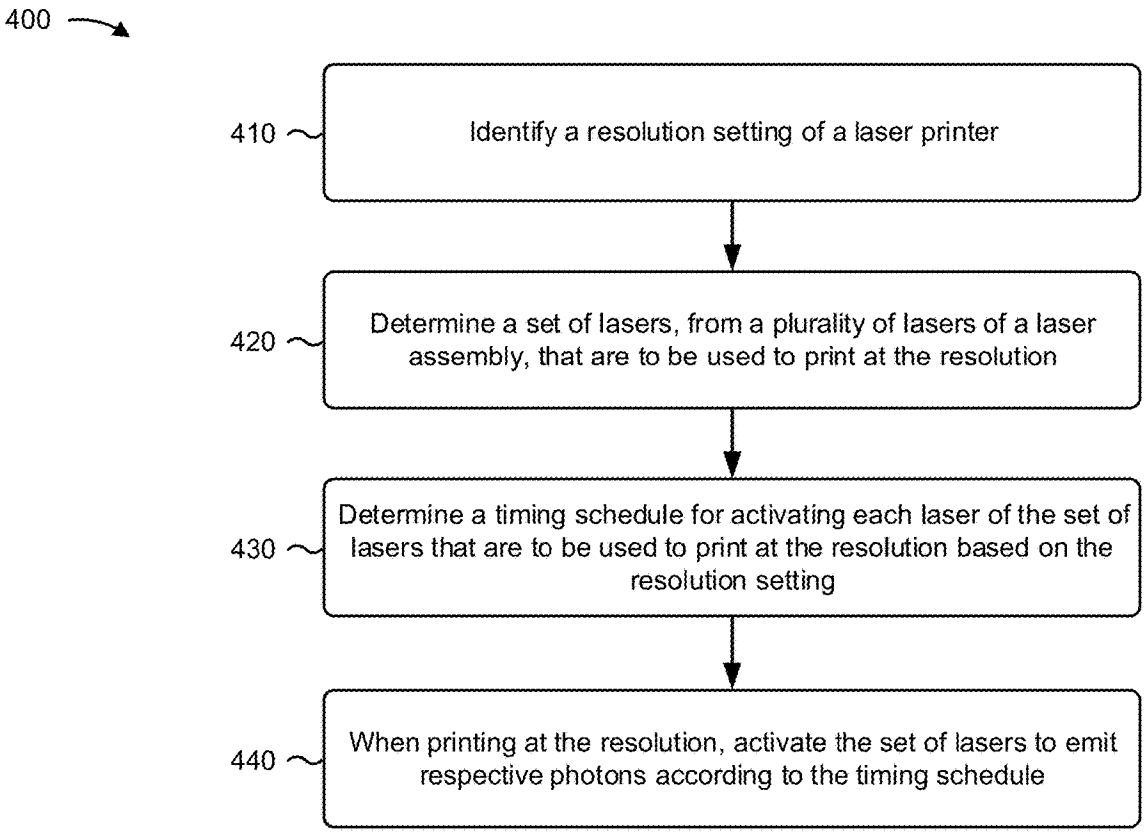
FIG. 4 is a flow chart of an example process to control a laser assembly for a laser printer.

FIG. 4 is a flow chart of an example process 400 to control a laser assembly for a laser printer. In some implementations, one or more process blocks of FIG. 4 may be performed by laser printer 220. In some implementations, one or more process blocks of FIG. 4 may be performed by another device or a group of devices separate from or including laser printer 220, such as user device 210.

As shown in FIG. 4, process 400 may include identifying a resolution setting of a laser printer (block 410). For example, laser printer 220 may identify the resolution setting. In some implementations, laser printer 220 may identify the resolution setting based on receiving a printing request from user device 210, based on receiving a user input received via a user interface of laser printer 220, based on identifying a characteristic (e.g., a size, a resolution, a tone, a color setting, and/or the like) of an image that is to be printed, and/or the like.

According to some implementations, the resolution setting may indicate a resolution at which laser printer 220 is to print. For example, laser printer 220 may be set to print at a resolution that is greater than 3600 DPI. In some implementations, the resolution setting may be based on a resolution indicated in a printing request from user device 210. For example, the resolution setting in the printing request may cause laser printer 220 to identify the resolution as the resolution setting in the printing request. Additionally, or alternatively, the resolution setting may be based on a characteristic of toner installed in laser printer 220. For example, the resolution setting may be based on a dimension (e.g., a diameter, a density, and/or the like) or type (e.g., chemical compound) of toner particles in the toner of laser printer 220. Accordingly, in some implementations, laser printer 220 may determine a type of toner installed in laser printer 220.

In this way, laser printer 220 may identify the resolution setting of laser printer 220 to enable laser printer 220 to determine a set of lasers to be used to print at the resolution.

As further shown in FIG. 4, process 400 may include determining a set of lasers from a plurality of lasers of a laser assembly that are to be used to print at the resolution (block 420). For example, laser printer 220 may determine the set of lasers to be used to print at the resolution. In some implementations, laser printer 220 may determine the set of lasers to be used to print based on receiving a printing request from user device 210, based on receiving a user input via a user interface of laser printer 220, and/or the like.

According to some implementations, laser printer 220 may include a laser assembly that includes a plurality of lasers. As such, based on the resolution setting, laser printer 220 may determine which lasers (a set of lasers) of the plurality of lasers are to be used to print an image at a resolution indicated by the resolution setting. As used herein, a set of lasers may include one or more lasers of a laser assembly of laser printer 220. Additionally, or alternatively, the laser assembly of laser printer 220 may include a prism (e.g., a cone prism, a tetrahedron, a square-based pyramid prism, and/or the like). The lasers of the laser assembly may be arranged in an arc shape or a circular shape, such that a distance between the prism and each of the plurality of lasers is substantially equal (e.g., within a manufacturing tolerance). In some implementations, laser printer 220 may optically combine, via the prism, photons emitted from the lasers of the laser assembly to generate a photon beam. For example, the prism of laser printer 220 may redirect photons at an angle of ninety degrees to combine the photons to generate the photon beam. In such cases, laser printer 220 may generate the photon beam to have a lower intensity than a laser beam capable of being emitted from one or more of the plurality of lasers of the assembly device. As used herein, an intensity of a laser beam or a photon beam may correspond to a density or an amount of photons emitted from one or more lasers at or during a particular time period.

Furthermore, in some implementations, the laser assembly of laser printer 220 may include a collimator lens to focus or narrow photons (e.g., of the photon beam) from the cone prism toward a scanning mirror of laser printer 220. The scanning mirror may reflect the photon beam toward a photo drum of laser printer 220 to generate a fine charge zone (e.g., a charge zone that attracts less than 20 toner particles) capable of facilitating high print resolution (e.g., greater than 3600 DPI).

As an example, laser printer 220 may include a laser assembly with eight lasers. As such, based on a first resolution setting, laser printer 220 may determine that a set of four of the eight lasers are to be used to print at the resolution indicated by the resolution setting. In such a case, based on a second resolution setting, laser printer 220 may determine that all eight of the eight lasers are to be used to print at the resolution indicated by the resolution setting.

In some implementations, laser printer 220 may determine a set of lasers of the plurality of lasers that are capable of generating a photon beam with an intensity determined for generating charge regions configured to attract an amount of toner for printing at a resolution indicated in the resolution setting. In some implementations, the photon beam is generated with the minimum intensity for printing at the resolution indicated in the resolution setting. Accordingly, referring to the example of above, although laser printer 220 may determine that all eight lasers and the set of four lasers may both achieve the resolution indicated by the resolution setting, laser printer 220 may determine that the set of four lasers are to be used, rather than all eight lasers, in order to conserve power resources of laser printer 220.

In this way, laser printer 220 may determine a set of lasers, of a laser assembly, that are to be used to print an image to enable laser printer 220 to determine a timing schedule for the set of lasers to print the image.

As further shown in FIG. 4, process 400 may include determining a timing schedule for activating each laser of the set of lasers that are to be used to print at the resolution based on the resolution setting (block 430). For example, laser printer 220 is to determine the timing schedule for activating each laser of the set of lasers. In some implementations, laser printer 220 may determine the timing schedule for activating each laser of the set of lasers based on determining the set of lasers, based on receiving a printing request, based on receiving a user input, and/or the like.

As used herein, laser printer 220 determines the timing schedule for activating lasers of laser printer 220 based on the set of lasers of the plurality of lasers that are to be activated and a resolution setting of laser printer 220. According to some implementations, laser printer 220 may determine the timing schedule based on determining an intensity of a photon beam to be generated from the lasers to print at the resolution. Accordingly, laser printer 220 may determine the timing schedule to cause each of the set of lasers to emit the respective photons to enable a photo drum of laser printer 220 to facilitate printing at the resolution (e.g., via fine charge zones of a photo drum of laser printer 220).

In some implementations, laser printer 220 may determine a timing schedule for activating the lasers of the set of lasers such that laser printer 220 activates each laser of the set of lasers and deactivates each laser of the set of lasers before the lasers of the set of lasers reach a laser beam threshold. For example, laser printer 220 may determine an amount of time needed for each of the set of lasers to reach (when applied with a threshold power) a photon emission threshold (when the laser is emitting photons but has not reached a laser beam threshold to emit enough photons to form a laser beam) and an amount of time for each of the set of lasers to reach a laser beam threshold (when the laser is emitting enough photons to form a laser beam). As such, laser printer 220 may determine a timing schedule such that the set of lasers may emit photons to generate a photon beam that is less intense than a laser beam (e.g., a laser beam that can be emitted from each of the set of lasers). For example, laser printer 220 may combine the photons via a cone prism of a laser assembly of laser printer 220 to form the photon beam. As such, laser printer 220 may determine the timing schedule to determine when the lasers of the set of lasers are to be powered on and/or powered off to achieve the intensity of the photon beam, which may be less than an intensity of the laser beam emitted from the lasers when the laser devices are powered up to the laser beam threshold.

In some implementations, laser printer 220 may adjust an intensity of the photon beam based on the timing schedule. The intensity of the photon beam at any point in time may be based on the number of lasers whose outputs are combined to form the photon beam. For example, laser printer 220 may generate the photon beam to have a first intensity when there is a first time period between activating a first laser of the plurality of lasers and activating a second laser of the plurality of lasers, and a second intensity when there is a second time period between activating the first laser and the second laser. In such a case the first intensity may be less than the second intensity when the first time period is greater than the second time period. Accordingly, laser printer 220 may adjust an intensity of the photon beam based on a resolution setting to achieve a resolution indicated by the resolution setting.

Therefore, in some implementations, laser printer 220 may determine the timing schedule such that laser printer 220 causes a first laser to be activated to emit first photons and causes a second laser to be activated to emit second photons after the first laser, where a time period between activating the first laser and the second laser is less than a photon cycle time of the first laser (or the second laser). As used herein, a photon cycle time is a length of time between when a laser of laser printer 220 that is emitting photons is turned off and turned back on to emit more photons.

In this way, laser printer 220 may determine a timing schedule for activating each laser of the set of lasers to form a photon beam based on the resolution setting and enabling laser printer 220 to activate the set of laser to emit the respective photons.

As further shown in FIG. 4, process 400 may include, when printing at the resolution, activating the set of lasers to emit respective photons according to the timing schedule (block 440). For example, laser printer 220 may activate the set of lasers to emit the respective photons according to the timing schedule to generate a photon beam. In some implementations, laser printer 220 may activate the set of lasers according to the timing schedule based on determining the timing schedule.

According to some implementations, laser printer 220 activates the lasers of the set of lasers by applying a threshold amount of power to the lasers. The threshold amount of power may be enough power to cause the lasers to emit respective photons (e.g., to reach a photon emission threshold). For example, if the lasers are laser diodes, the threshold amount of power may be an amount of power to energize a p-n junction of the laser diode to emit the photons. In some implementations, the threshold amount of power may be less than or equal to a threshold amount of power to cause the laser to generate a laser beam (e.g., to reach a laser beam threshold). In some implementations, a same threshold amount of power may activate the lasers to begin emitting photons and/or to emit a laser beam. In some implementations, the threshold amount of power to activate the lasers to begin emitting photons or to emit a laser beam may vary across the lasers. Accordingly, each of the lasers may have the same or different operating characteristics.

In this way, laser printer 220 may activate each laser of the set of lasers according to a timing schedule to generate a photon beam to enable laser printer 220 to print at a high print resolution (e.g., greater than 3600 DPI).

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

Figure 5A:
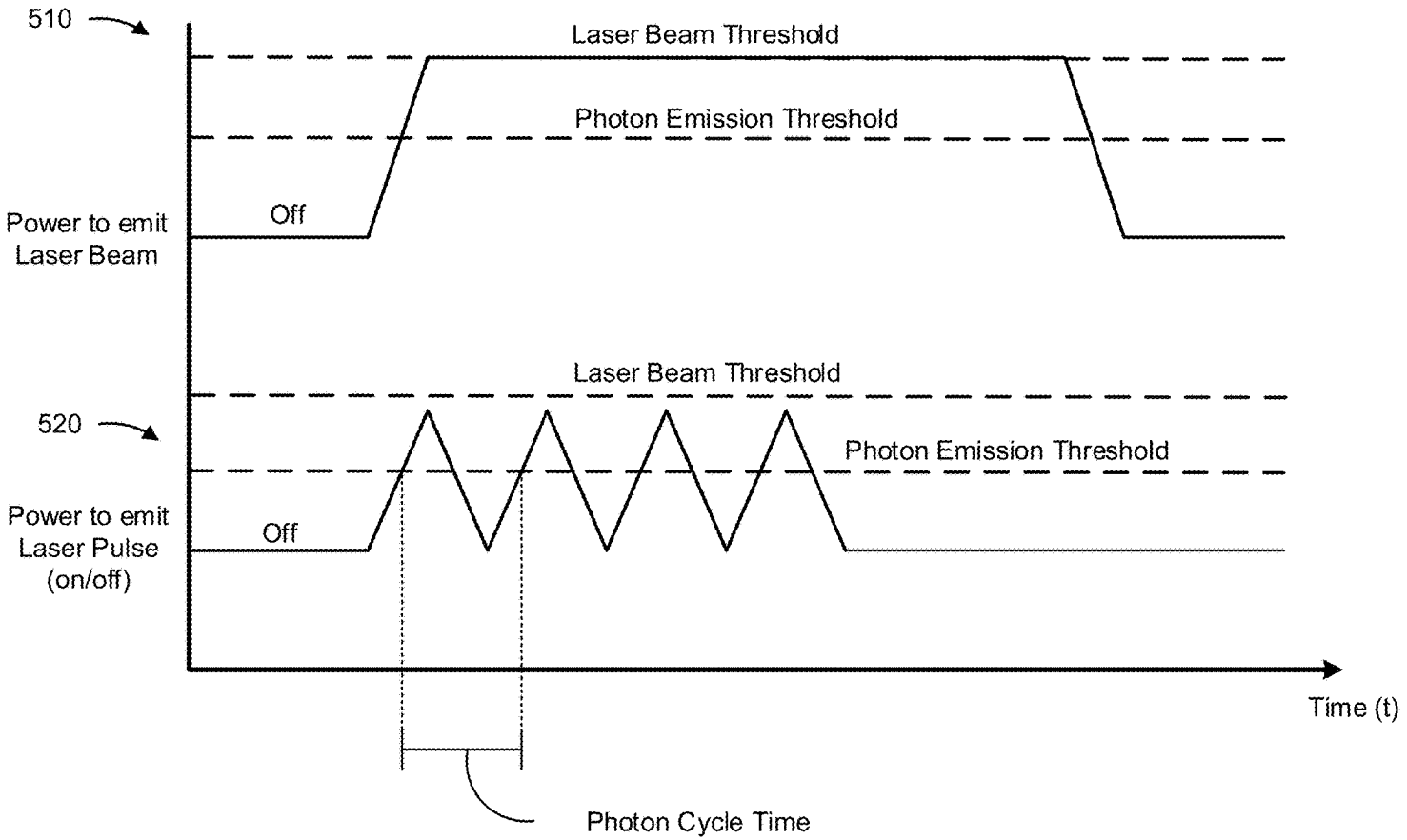
FIGS. 5A-5B are diagrams of example timing schedules relating to the example process shown in FIG. 4.
Figure 5B:
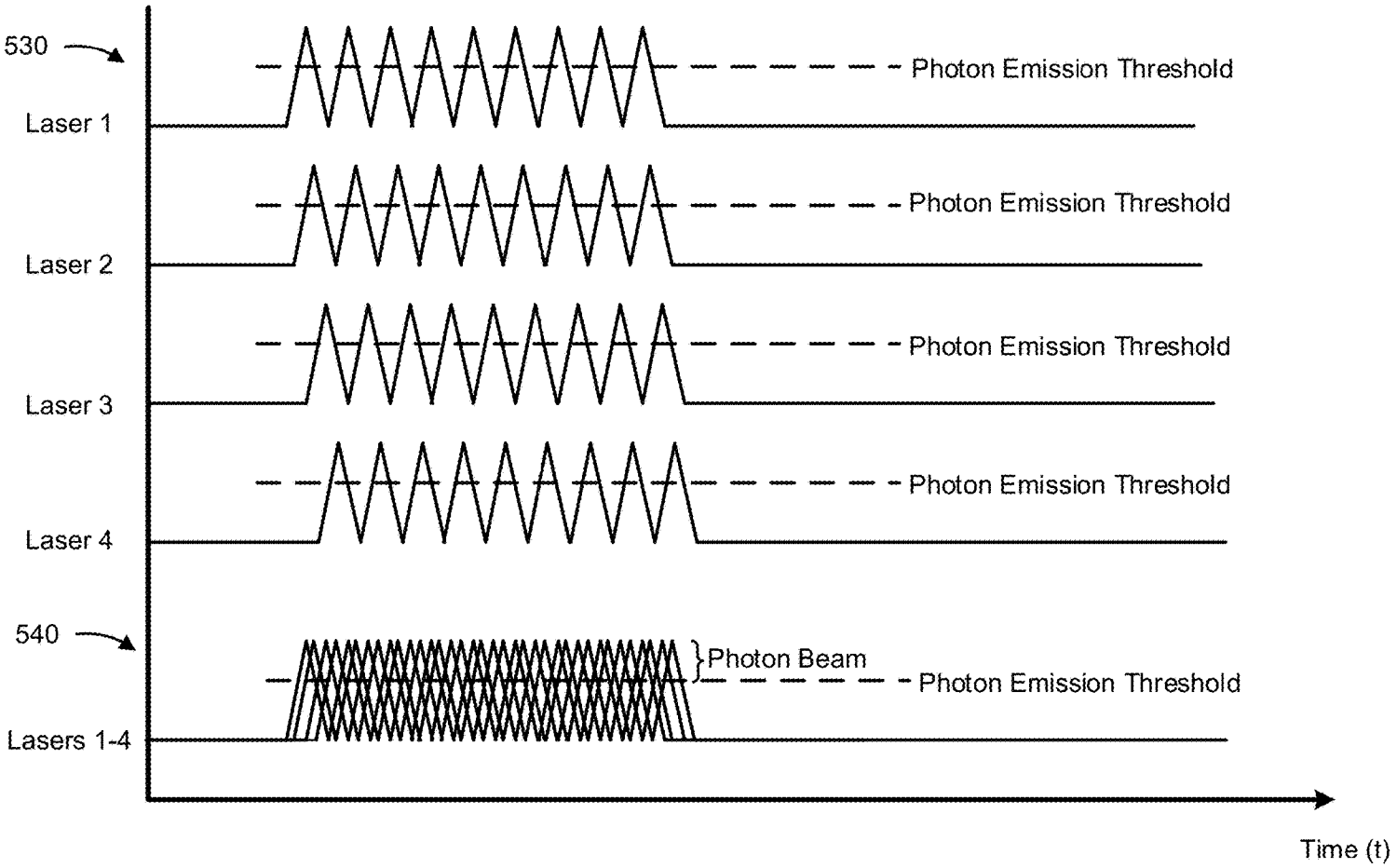

FIGS. 5A and 5B are diagrams of example timing schedules relating to example process 400 shown in FIG. 4. FIGS. 5A and 5B show examples of timing schedules to control a laser assembly of laser printer 220.

As shown in FIG. 5A, and by reference number 510, power for a laser to emit a laser beam is shown. As shown in FIG. 5A, to emit a laser beam, the power is off, then when applied, ramps up to a laser beam threshold before power to the laser is shut down and the laser beam turns off after dropping below the laser beam threshold. As further shown by reference number 510, when the power is between a photon emission threshold and the laser beam threshold, the laser may be emitting photons, but not enough photons to form a laser beam. According to some implementations, the laser beam of FIG. 5A may create a charge zone on a photo drum of laser printer 220 that cannot achieve a high resolution (e.g., greater than 3600 DPI).

As further shown in FIG. 5A, and by reference number 520, power for a laser to generate a laser pulse (where the power is turned on and off) is shown. As shown in FIG. 5A, to emit a laser pulse, the power is turned on and turned off before or as soon as the power reaches the laser beam threshold. Accordingly, the laser may periodically emit a laser beam (i.e., pulse), and may emit photons when the power applied is between a photon emission threshold and the laser beam threshold. As further shown by reference number 520, a photon cycle time is indicated as corresponding to the length of time that begins when the laser is emitting photons during a first pulse, is turned off, and ends when the laser emits photons during a second pulse. According to some implementations, the laser pulse in FIG. 5A may not emit enough photons to create a charge zone on a photo drum of laser printer 220.

As shown in FIG. 5B, and by reference number 530, power for example lasers 1-4 to emit photons is shown. In the example of FIG. 5B, each of lasers 1-4 are pulsed for a period of time. As further shown in FIG. 5B, and by reference number 540, a threshold power is applied in a staggered manner (or sequentially (i.e., 1, 2, 3, 4, 1, 2, 3, 4, etc.) such that when the lasers are combined (e.g., via a prism, such as a cone prism), a photon beam may be formed. For example, the photon beam is formed from photons generated when the power is above the photon emission threshold. The photons emitted from each of Lasers 1-4 may be combined (e.g., via the prism) to form the photon beam. The example photon beam of FIG. 5B may have a lower intensity than a laser beam emitted from any one of lasers 1-4 or the laser beam emitted in FIG. 5A.

Accordingly, a timing schedule may be used to activate and/or deactivate lasers to form a photon beam that has a lower intensity than a laser beam of the lasers. In such instances, the photon beam may be used by laser printer 220 to achieve a high print resolution (e.g., greater than 3600 DPI).

As indicated above, FIG. 5 is provided merely as an example. Other examples are possible and may differ from what was described with regard to FIG. 5.

Figure 6:
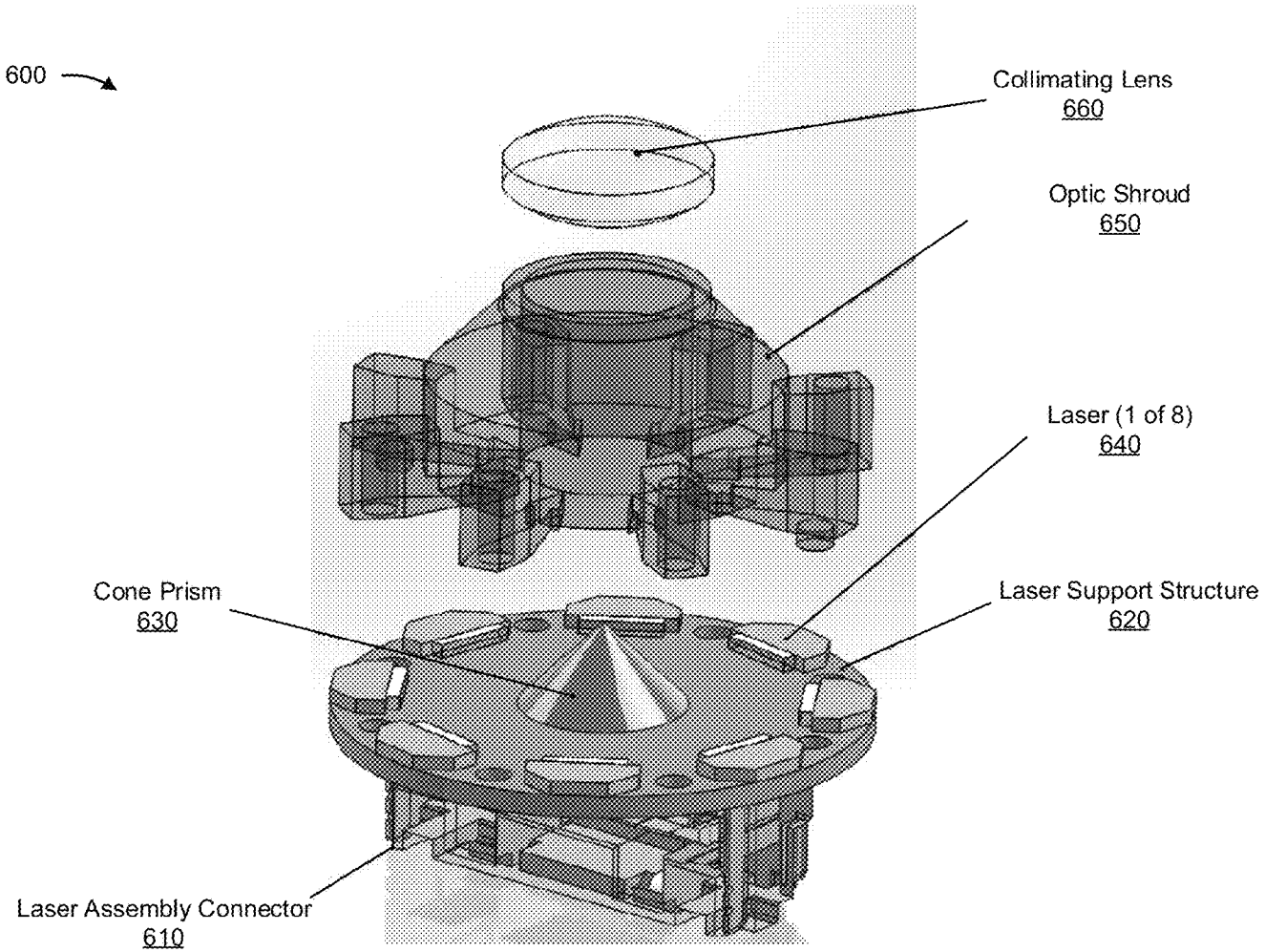
FIG. 6 is a diagram of an example implementation of a laser assembly for a laser printer as described herein.

FIG. 6 is a diagram of an example implementation 600 relating to example process 400 shown in FIG. 4. FIG. 6 shows an example of a laser assembly for laser printer 220 as described herein. FIG. 6 is an exploded view of the example of the laser assembly.

As shown in FIG. 6, a laser assembly includes a laser assembly connector 610, a laser support structure 620, a cone prism 630, eight lasers 640, an optic shroud 650, and a collimating lens 660. In some implementations, the laser assembly of example implementation 600 may be installed within a laser printer. For example, the laser assembly of FIG. 6 may form all or a part of a module laser assembly that can be installed within laser printer 220. Accordingly, the laser assembly of FIG. 6 may be used to replace another laser assembly (e.g., a laser assembly with a single laser diode, an inoperable laser assembly, and/or the like) by installing the laser assembly in laser printer 220 via laser assembly connector 610. As such, laser assembly connector 610 may serve as an interface with laser printer 220.

As shown, the laser assembly of example implementation 600 includes lasers 640 and cone prism 630 connected to or formed as a part of laser support structure 620. As shown, laser support structure 620 is circular. According to some implementations, the laser support structure may have a diameter of less than four centimeters (4 cm). Lasers 640 are placed in an arc or circle around the laser support structure 620 with cone prism 630 placed in the center of laser support structure 620. As such, a distance between cone prism 630 and each of the lasers 640 may be substantially equal (e.g., within a manufacturing tolerance). The lasers 640 in the example of FIG. 6 may be "side firing" laser diodes in that lasers 640 may be mounted to a support surface of laser support structure 620 and may emit photons parallel to the support surface of laser support structure 620 toward cone prism 630. As such, the photons from lasers 640 may hit a conical surface of cone prism 630 and be redirected (e.g., ninety degrees) through a point of cone prism 630 toward collimator lens 660. Accordingly, cone prism 630 may optically combine photons from lasers 640 to generate a photon beam (which may have less of an intensity than one or more laser beams capable of being emitted by lasers 640).

The photon beam may pass through the optic shroud, which may support collimator lens 660, toward collimator lens 660. Collimator lens 660 may focus photons of the photon beam such that the photons can be directed toward other components of laser printer 220 to facilitate printing at a high print resolution (e.g., greater than 3600 DPI).

In some implementations, the laser assembly of example implementation 600 may include a laser controller to control (e.g., activate/deactivate) the lasers 640. For example, the controller may be configured to selectively activate one or more of lasers 640 to create a charge zone of a photo drum of laser printer 220. In such a case, photons emitted from each of the selectively activated one or more lasers 640 may be combined (e.g., via cone prism 630) to create the charge zone, the output of each of the one or more lasers being less than an output at a laser beam threshold of the respective lasers 640.

Accordingly, the example laser assembly of example implementation 600 may be used to generate an adjustable photon beam to enable laser printer 220 to achieve a high print resolution (e.g., greater than 3600 DPI). In some implementations, operation of the example laser assembly may be dynamically controlled to achieve fine grain control over a print resolution by variably adjusting an intensity of an adjustable photon beam.

As indicated above, FIG. 6 is provided merely as an example. Other examples are possible and may differ from what was described with regard to FIG. 6.

Accordingly, some example implementations herein enable a laser printer to generate a photon beam, from photons of a plurality of lasers, that has an intensity capable of achieving a high print resolution (e.g., greater than 3600 DPI). The intensity of the photon beam may be less than an intensity of a laser beam capable of being emitted by each of the plurality of lasers. Furthermore, using example implementations described herein, a laser printer may conserve toner resources by using less toner to print at a higher resolution.

The foregoing disclosure provides illustration and description, but is not intended to be exhaustive or to limit the implementations to the precise form disclosed. Modifications and variations are possible in light of the above disclosure or may be acquired from practice of the implementations.

As used herein, the term component is intended to be broadly construed as hardware, firmware, or a combination of hardware and software.

Some implementations are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, or the like.

Certain user interfaces have been described herein and/or shown in the figures. A user interface may include a graphical user interface, a non-graphical user interface, a text-based user interface, or the like. A user interface may provide information for display. In some implementations, a user may interact with the information, such as by providing input via an input component of a device that provides the user interface for display. In some implementations, a user interface may be configurable by a device and/or a user (e.g., a user may change the size of the user interface, information provided via the user interface, a position of information provided via the user interface, etc.). Additionally, or alternatively, a user interface may be pre-configured to a standard configuration, a specific configuration based on a type of device on which the user interface is displayed, and/or a set of configurations based on capabilities and/or specifications associated with a device on which the user interface is displayed.

It will be apparent that systems and/or methods, described herein, may be implemented in different forms of hardware, firmware, or a combination of hardware and software. The actual specialized control hardware or software code used to implement these systems and/or methods is not limiting of the implementations. Thus, the operation and behavior of the systems and/or methods were described herein without reference to specific software code—it being understood that software and hardware can be designed to implement the systems and/or methods based on the description herein.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items (e.g., related items, unrelated items, a combination of related and unrelated items, etc.), and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A device comprising:

one or more memories; and one or more processors, communicatively coupled to the one or more memories, configured to:

identify a resolution setting of a laser printer, the resolution setting indicating a resolution at which the laser printer is to print;

determine a set of lasers, from a plurality of lasers of a laser assembly, that are to be used to print at the resolution, the laser assembly comprising the plurality of lasers to emit respective photons toward a prism, and the prism being to redirect the respective photons toward a collimator lens of the laser printer to form a photon beam;

determine an amount of time needed for each laser, of the set of lasers, to reach a photon emission threshold;

determine a timing schedule for activating each laser, of the set of lasers, that are to be used to print at the resolution, using the photon beam, based on the amount of time needed for each laser, of the set of lasers, to reach the photon emission threshold; and activate the set of lasers to emit the respective photons according to the timing schedule.

2. The device of claim 1, where the one or more processors, when determining the timing schedule, are configured to:

determine the timing schedule to cause each laser, of the set of lasers, to emit the respective photons to enable a photo drum to facilitate printing at the resolution.

3. The device of claim 1, where the one or more processors, when determining the time schedule, are configured to:

determine the timing schedule to:

cause a first laser to be activated to emit first photons; and cause a second laser to be activated to emit second photons after the first laser, and where a time period between activating the first laser and the second laser is less than a photon cycle time of the first laser.

4. The device of claim 1, where the one or more processors, when identifying the resolution setting, are configured to:

determine a type of toner installed in the laser printer; and where the one or more processors, when determining the timing schedule, are to:

determine the timing schedule based on the type of toner installed in the laser printer.

5. The device of claim 1, where the one or more processors, when activating each of the set of lasers, are configured to:

apply a threshold amount of power to each laser of the set of lasers, the threshold amount of power to cause the set of lasers to emit the respective photons.

6. The device of claim 1, where the set of lasers comprises at least two lasers.

7. The device of claim 1, where the resolution comprises a resolution of at least 3600 dots per inch (DPI).

8. A laser printer comprising:

a laser assembly comprising:

a collimator lens;

a plurality of lasers to emit respective photons; and a prism to redirect the respective photons from the plurality of lasers toward the collimator lens;

a photo drum, where the respective photons, redirected through the collimator lens, are combinable for generating a photon beam to create a charge zone on the photo drum to achieve a printing resolution of at least 3600 dots per inch (DPI); and one or more processors configured to:

determine an amount of time needed for each laser, of the plurality of lasers, to reach a photon emission threshold;

determine a timing schedule for activating each laser, of the plurality of lasers, based on the amount of time needed each laser, of the plurality of lasers, to reach the photon emission threshold; and activate the plurality of lasers to emit the respective photons when printing at the printing resolution according to the timing schedule.

9. The laser printer of claim 8, where the respective photons, when emitted according to the timing schedule and redirected through the collimator lens, effectively generate the photon beam to achieve the printing resolution, and where an intensity of the photon beam is based on the timing schedule for activating each of the plurality of lasers.

10. The laser printer of claim 8, where the photon beam has a first intensity when there is a first time period between activating a first laser of the plurality of lasers and activating a second laser of the plurality of lasers, where the photon beam has a second intensity when there is a second time period between activating the first laser and the second laser, and where the first intensity is less than the second intensity when the first time period is greater than the second time period.

11. The laser printer of claim 8, where the one or more processors, when determining the timing schedule, are configured to:

determine the timing schedule to:

cause a first laser to be activated; and cause a second laser to be activated after the first laser, where the plurality of lasers includes the first laser and the second laser, and where a time period between the first laser being activated and the second laser being activated is less than a photon cycle time of the first laser.

12. The laser printer of claim 8, where the prism comprises a cone prism, and where the respective photons are emitted from the plurality of lasers toward a conical surface of the cone prism, such that the cone prism redirects the respective photons at an angle of ninety degrees toward the collimator lens.

13. The laser printer of claim 8, where the one or more processors, when activating the plurality of lasers, are configured to:

sequentially apply a threshold amount of power to each laser of the plurality of lasers, the threshold amount of power to cause the plurality of lasers to emit respective photons.

14. The laser printer of claim 8, where the plurality of lasers are arranged in an arc shape or a circular shape, such that a distance between the prism and each laser, of the plurality of lasers, is substantially equal.

15. A laser assembly for a laser printer, the laser assembly comprising:

a plurality of lasers to emit respective photons;

a prism to redirect the respective photons emitted from the plurality of lasers toward a collimator lens of the laser printer to generate a photon beam; and one or more processors configured to:

determine an amount of time needed for each laser, of the plurality of lasers, to reach a photon emission threshold;

determine a timing schedule for individually activating the plurality of lasers based on the amount of time needed each laser, of the plurality of lasers, to reach the photon emission threshold; and control activation of each of the plurality of lasers to emit the respective photons according to the timing schedule to form the photon beam.

16. The laser assembly of claim 15, where the prism comprises a cone prism, and where the respective photons are emitted from the plurality of lasers toward a conical surface of the cone prism, such that the cone prism redirects the respective photons toward the collimator lens.

17. The laser assembly of claim 15, where the plurality of lasers are arranged in an arc shape or a circular shape, such that a distance between the prism and each of the plurality of lasers is substantially equal.

18. The laser assembly of claim 15, where the photon beam has:

a first intensity when there is a first time period between activating a first laser of the plurality of lasers and activating a second laser of the plurality of lasers, and a second intensity when there is a second time period between activating the first laser and the second laser, and where the first intensity is less than the second intensity when the first time period is greater than the second time period.

19. The laser assembly of claim 15, where the one or more processors, when determining the timing schedule, are configured to:

determine a time period between activating a first laser of the plurality of lasers and activating a second laser of the plurality of lasers, and where the time period between activating the first laser and activating the second laser is less than a photon cycle time of the first laser or the second laser.

20. The laser assembly of claim 15, where the plurality of lasers are used to print at a resolution of at least 3600 dots per inch (DPI).

* * * * *